US006164647A

United States Patent [19]

Chee

[11] Patent Number: 6,164,647

[45] Date of Patent: Dec. 26, 2000

[54] CASINO WHEEL GAME SYSTEM

[76] Inventor: Ah-Him Chong Toc Chee, 15 A Short Street, Joondanna, W.A. 6060, Australia

[21] Appl. No.: 09/199,384

[22] Filed: Nov. 25, 1998

[51] Int. Cl.[7] ..... A63B 71/00

[52] U.S. Cl. ..... 273/142 R; 273/142 F

[58] Field of Search ..... 273/142 R, 142 F

[56] References Cited

U.S. PATENT DOCUMENTS

| | | | |
|---|---|---|---|
| 1,370,682 | 3/1921 | Buys | 273/142 F |
| 1,676,410 | 7/1928 | Paul | 273/142 F |
| 1,709,401 | 4/1929 | Hermann | 273/142 F |
| 2,087,555 | 7/1937 | Simpson | 273/142 |
| 2,210,201 | 8/1940 | Draper et al. | 273/141 |
| 2,721,082 | 10/1955 | Hunold | 273/138 |
| 3,090,623 | 5/1963 | Dugan | 273/142 |
| 3,166,323 | 1/1965 | Anderson | 273/119 |
| 3,222,069 | 12/1965 | Ruizzo | 273/142 |
| 3,853,324 | 12/1974 | Reiner et al. | 273/142 E |
| 4,323,248 | 4/1982 | Zingale . | |
| 4,906,005 | 3/1990 | Manabe | 273/142 R |
| 4,941,665 | 7/1990 | Klamer . | |
| 5,636,838 | 6/1997 | Caro . | |
| 5,833,239 | 11/1998 | Eleidjian . | |
| 5,879,235 | 3/1999 | Kaneko et al. | 463/34 |

FOREIGN PATENT DOCUMENTS 0 948 976 10/1999 United Kingdom .

*Primary Examiner*—Mark S. Graham
*Assistant Examiner*—D Collins

[57] ABSTRACT

A roulette assembly is provided including a lower wheel divided into a plurality of sections each representative of at least one of a unique number and a unique color. Also included is an upper wheel rotatably mounted on the lower wheel and divided into a plurality of sections each representative of at least one of a unique number and a unique color. Upon the upper wheel and the lower wheel being spun, the upper wheel slows to engage with the lower wheel and a unique number and color combination is indicated.

10 Claims, 5 Drawing Sheets

CASINO WHEEL GAME SYSTEM

BACKGROUND OF THE INVENTION

1. Field of the Invention

The present invention relates to roulette wheels and more particularly pertains to a new casino wheel game system for providing a game which renders various number and color combinations in a unique manner.

1. Description of the Prior Art

The use of roulette wheels is known in the prior art. More specifically, roulette wheels heretofore devised and utilized are known to consist basically of familiar, expected and obvious structural configurations, notwithstanding the myriad of designs encompassed by the crowded prior art which have been developed for the fulfillment of countless objectives and requirements.

Known prior art roulette wheels include U.S. Pat. No. 1,578,412; U.S. Pat. No. 4,077,631; U.S. Pat. No. 3,090,623; U.S. Pat. No. 4,357,015; U.S. Pat. No. 4,22,561; and Foreign applications EP 0 714 683 A1 and WO 97/18870.

In these respects, the casino wheel game system according to the present invention substantially departs from the conventional concepts and designs of the prior art, and in so doing provides an apparatus primarily developed for the purpose of providing a game which renders various number and color combinations in a unique manner.

SUMMARY OF THE INVENTION

In view of the foregoing disadvantages inherent in the known types of roulette wheels now present in the prior art, the present invention provides a new casino wheel game system construction wherein the same can be utilized for providing a game which renders various number and color combinations in a unique manner.

The general purpose of the present invention, which will be described subsequently in greater detail, is to provide a new casino wheel game system apparatus and method which has many of the advantages of the roulette wheels mentioned heretofore and many novel features that result in a new casino wheel game system which is not anticipated, rendered obvious, suggested, or even implied by any of the prior art roulette wheels, either alone or in any combination thereof.

To attain this, the present invention generally comprises a first roulette assembly, as shown in FIGS. 1 & 6. Such first roulette assembly includes a base fixedly mounted on a recipient surface. Such base includes a circular bottom with a peripheral lip integrally coupled to a periphery of the circular bottom and extending upwardly therefrom. A lower wheel is rotatably mounted on the base in concentric relationship therewith. Such lower wheel includes a circular bottom with an inner annular lip integrally coupled to the circular bottom at a location spaced from a periphery of the circular bottom and extending upwardly therefrom. Associated therewith is an outer annular lip integrally coupled to the periphery of the circular bottom and extended upwardly therefrom. As shown in FIG. 6, a plurality of radially extending dividers are mounted on the circular bottom between the inner annular lip and the outer annular lip. As such, a plurality of equally sized compartments are defined. A plurality of apertures are each formed in the inner annular lip at one of the compartments for reasons that will soon become apparent. Each compartment has a unique number and color combination associated therewith. Yet another component of the first roulette assembly includes an upper wheel rotatably mounted with respect to the lower wheel in concentric relationship therewith. The upper wheel has a diameter less than that of the inner annular lip of the lower wheel and a height equal to a height of the annular lips thereof. Note FIG. 1. The upper wheel includes a plurality of solenoids mounted on the upper wheel which extend radially from a center of the upper wheel and are spaced equally apart. Each solenoid includes a transducer with a ball mounted on an end thereof for being randomly and removably inserted within one of the apertures of the compartments. This precludes the rotation of the upper wheel with respect to the lower wheel and further indicates one of the number and color combinations as a winner. In one other variation, each of the solenoid and transducers are equipped with a ball of a different color. With reference now to FIGS. 2, 3, 4, 5 & 8, a second roulette assembly is shown to include a base fixedly mounted on a recipient surface. As shown best in FIG. 4, the base includes a circular bottom with a recess formed therein with a disk-shaped lower portion and an inverted frusto-conical upper portion. A peripheral lip is integrally coupled to a periphery of the circular bottom and extends upwardly therefrom. The peripheral lip has a C-shaped cross-section along a length thereof. The base further includes a spring biased manual ball injector for projecting a ball within the recess of the base. The second roulette assembly further includes a lower wheel rotatably mounted within the disk-shaped lower portion of the recess of the base. The lower wheel of the second roulette assembly is equipped with a planar top face and a side wall with an upright frusto-conical configuration. Such side wall has a plurality of vertically oriented lines positioned thereon for defining equally space sections each with a unique number associated therewith. As shown in FIG. 5, a horizontally oriented lower peripheral lip is mounted on a bottom edge of the side wall and extends radially therefrom. A plurality of upwardly extending tabs remain in alignment with the lines of the sections. Further, a plurality of vertically oriented posts are each mounted to a periphery of the top face of the lower wheel. It is important that each post be positioned at a central extent of one of the sections of the side wall thereof for reasons that will soon become apparent. As best shown in FIG. 5, the second roulette assembly includes an upper wheel having a disk-shaped configuration rotatably mounted on the top face of the lower wheel. The upper wheel has a top face including a pair of intersecting lines positioned thereon. Such lines divide the top face of the upper wheel into four equally sized sections each of which has a unique color associated therewith. The upper wheel further includes four flexible resilient flaps coupled to a periphery of the upper wheel and extending radially therefrom in alignment with the lines of the upper wheel. In use, the flaps are adapted to be biased between each of the posts of the lower wheel. Finally, a betting mat is provided for betting on various combinations of numbers and colors which are indicated by the roulette assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new casino wheel game system apparatus and method which has many of the advantages of the roulette wheels mentioned heretofore and many novel features that result in a new casino wheel game system which is not anticipated, rendered obvious, suggested, or even implied by any of the prior art roulette wheels, either alone or in any combination thereof.

It is another object of the present invention to provide a new casino wheel game system which may be easily and efficiently manufactured and marketed.

It is a further object of the present invention to provide a new casino wheel game system which is of a durable and reliable construction.

An even further object of the present invention is to provide a new casino wheel game system which is susceptible of a low cost of manufacture with regard to both materials and labor, and which accordingly is then susceptible of low prices of sale to the consuming public, thereby making such casino wheel game system economically available to the buying public.

Still yet another object of the present invention is to provide a new casino wheel game system which provides in the apparatuses and methods of the prior art some of the advantages thereof, while simultaneously overcoming some of the disadvantages normally associated therewith.

Still another object of the present invention is to provide a new casino wheel game system for providing a game which renders various number and color combinations in a unique manner.

Even still another object of the present invention is to provide a new casino wheel game system that includes a lower wheel divided into a plurality of sections each representative of at least one of a unique number and a unique color. Also included is an upper wheel rotatably mounted on the lower wheel and divided into a plurality of sections each representative of at least one of a unique number and a unique color. Upon the upper wheel and the lower wheel being spun the upper wheel slows to engage with the lower wheel, thereby indicating a unique number and color combination.

Still another object of the present invention is to provide an educational game for children to learn numbers, alphabets, and colors.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
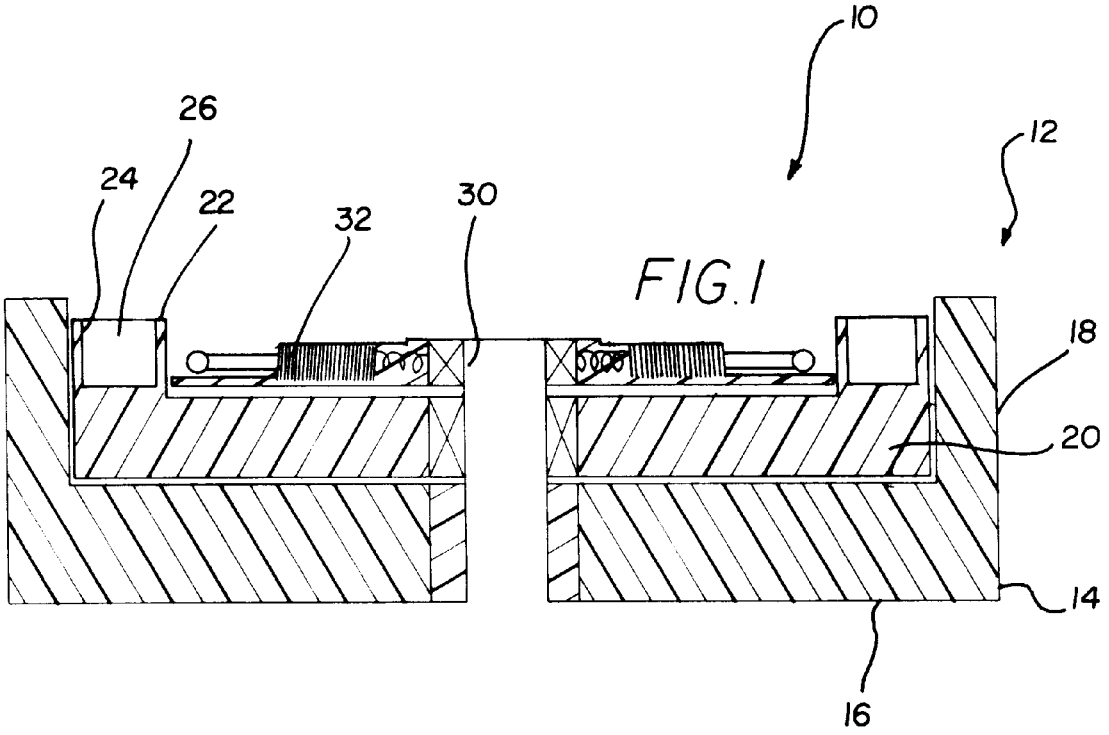
FIG. 1 is a side cross-sectional view of the first roulette assembly of the present invention.

With reference now to the drawings, and in particular to FIGS. 1 through 10 thereof, a new casino wheel game system embodying the principles and concepts of the present invention and generally designated by the reference numeral 10 will be described.

Figure 6:
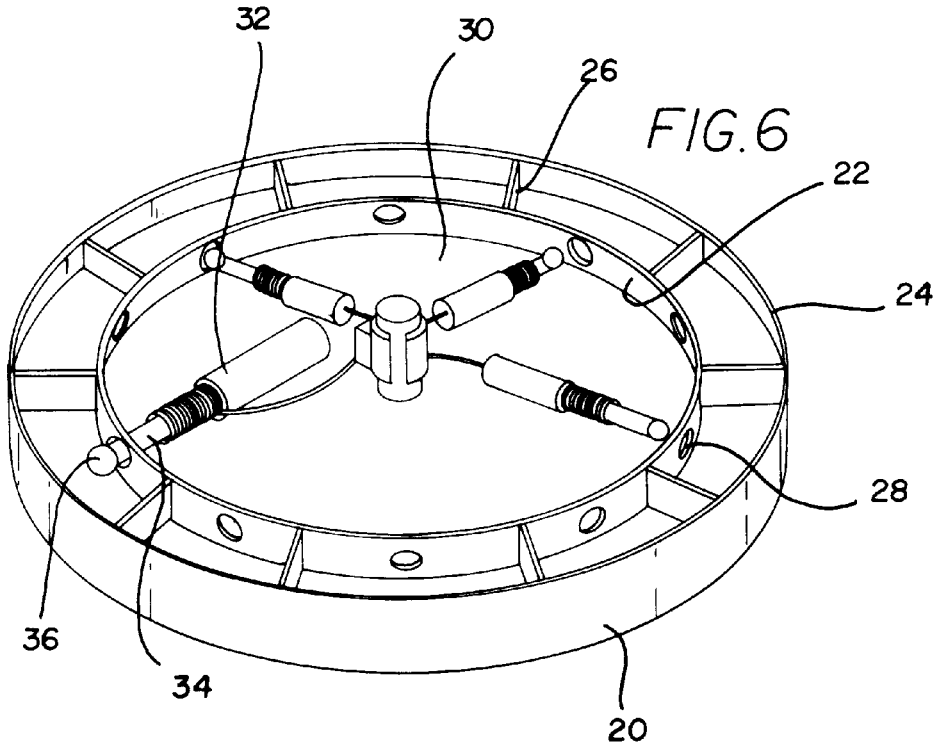
FIG. 6 is a perspective view of the first roulette assembly of the present invention.

The present invention, designated as 10, includes a first roulette assembly 12, as shown in FIGS. 1 & 6. Such first roulette assembly includes a base 14 fixedly mounted on a recipient surface. Such base includes a circular bottom 16 with a peripheral lip 18 integrally coupled to a periphery of the circular bottom and extending upwardly therefrom.

A lower wheel 20 is rotatably mounted on the base in concentric relationship therewith. Such lower wheel includes a circular bottom with an inner annular lip 22 integrally coupled to the circular bottom at a location spaced from a periphery of the circular bottom and extended upwardly therefrom. Associated therewith is an outer annular lip 24 integrally coupled to the periphery of the circular bottom and extended upwardly therefrom. As shown in FIG. 6, a plurality of radially extending dividers 26 are mounted on the circular bottom between the inner annular lip and the outer annular lip. As such, a plurality of equally sized compartments are defined. A plurality of apertures 28 are each formed in the inner annular lip at one of the compartments for reasons that will soon become apparent. Each compartment has a unique number and color combination associated therewith.

Yet another component of the first roulette assembly includes an upper wheel 30 rotatably mounted with respect to the lower wheel in concentric relationship therewith. In the alternative, the upper wheel may be fixed with respect to the lower wheel. The upper wheel has a diameter less than that of the inner annular lip of the lower wheel and a height equal to a height of the annular lips thereof. Note FIG. 1.

The upper wheel includes at least four solenoids 32 which extend radially from a center of the upper wheel and are spaced equally apart. Each solenoid includes a transducer 34 with a ball 36 mounted on an end thereof for being randomly and removably inserted within one of the apertures of the compartments. This precludes the rotation of the upper wheel with respect to the lower wheel and further indicates one of the number and color combinations as a winner. It should be noted that only one of the transducers is actuated at a time. Such transducer is picked randomly by a random number generator or the like upon the depression of a button by a user or after the cessation of a timer. Once picked, the solenoid is actuated by power being delivered thereto. This delivery of power is preferably accomplished by way of battery power, brush contacts or annular ring contacts. If per chance the solenoid is actuated while not in alignment with one of the apertures, the ball of the transducer slides along the inner annular lip until it can be inserted within the next aperture.

With reference now to FIGS. 2, 3, 4, 5 & 8, a second roulette assembly 40 is shown to include a base 42 fixedly mounted on a recipient surface. As shown best in FIG. 4, the base includes a circular bottom with a recess 44 formed therein having a disk-shaped lower portion 46 and an inverted frusto-conical upper portion 48. A peripheral lip 50 is integrally coupled to a periphery of the circular bottom and extends upwardly therefrom. The peripheral lip has a C-shaped cross-section along a length thereof. The base further includes a spring biased manual ball delivery mechanism 51 for projecting a ball within the recess of the base. In the alternative, a ball may be manually delivered.

Figure 5:
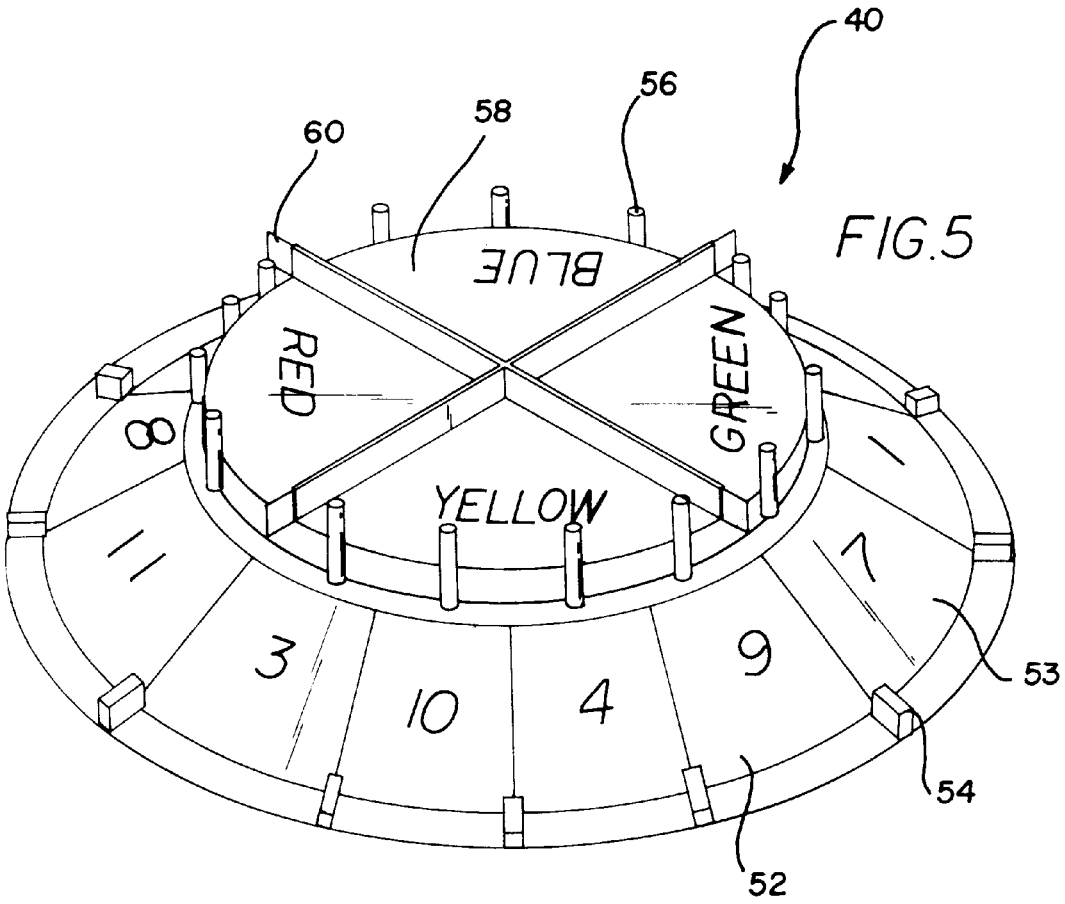
FIG. 5 is a perspective view of the second roulette assembly of the present invention.

The second roulette assembly further includes a lower wheel 52 rotatably mounted within the disk-shaped lower portion of the recess of the base. The lower wheel of the second roulette assembly is equipped with a planar top face and a side wall with an upright frusto-conical configuration. Such side wall has a plurality of vertically oriented lines positioned thereon for defining equally space sections 53 each with a unique number associated therewith. While numerals 1–12 are shown, it should be understood that numerals 1–15 or any other range may be employed. As shown in FIG. 5, a horizontally oriented lower peripheral lip is mounted on a bottom edge of the side wall and extends radially therefrom. A plurality of upwardly extending tabs 54 are mounted on the lower peripheral lip and remain in alignment with the lines of the sections. Further, a plurality of vertically oriented posts 56 are each mounted to a periphery of the top face of the lower wheel. Note FIG. 5. It is important that each post be positioned at a central extent of one of the sections of the side wall of the lower wheel for reasons that will soon become apparent.

As best shown in FIG. 5, the second roulette assembly includes an upper wheel 58 having a disk-shaped configuration rotatably mounted on the top face of the lower wheel. The upper wheel has a top face including a pair of intersecting lines positioned thereon. Such lines divide the top face of the upper wheel into four equally sized sections each of which has a unique color associated therewith. It should be noted that in an alternate embodiment, the upper wheel may be equipped with the number indicia and the lower wheel may be equipped with the colors. While any numbers of color may be used, the color divisions can be 2 upwards instead of only 4 colors. The upper wheel further includes four flexible resilient flaps 60 coupled to a periphery of the upper wheel and extending radially therefrom in alignment with the lines of the upper wheel. In use, the flaps are adapted to be biased between each of the posts of the lower wheel as the wheels are rotated with respect to each other.

Ideally, the numerals of the lower wheel are colored. Namely, with reference to FIGS. 8 & 9, numerals 1 & 12, 3 & 10, and 5 & 8 are gold. Numerals 2 & 11, 4 & 9, and 6 & 7 are black. Further, numeral 0 and the butterfly are silver colored.

Figure 2:
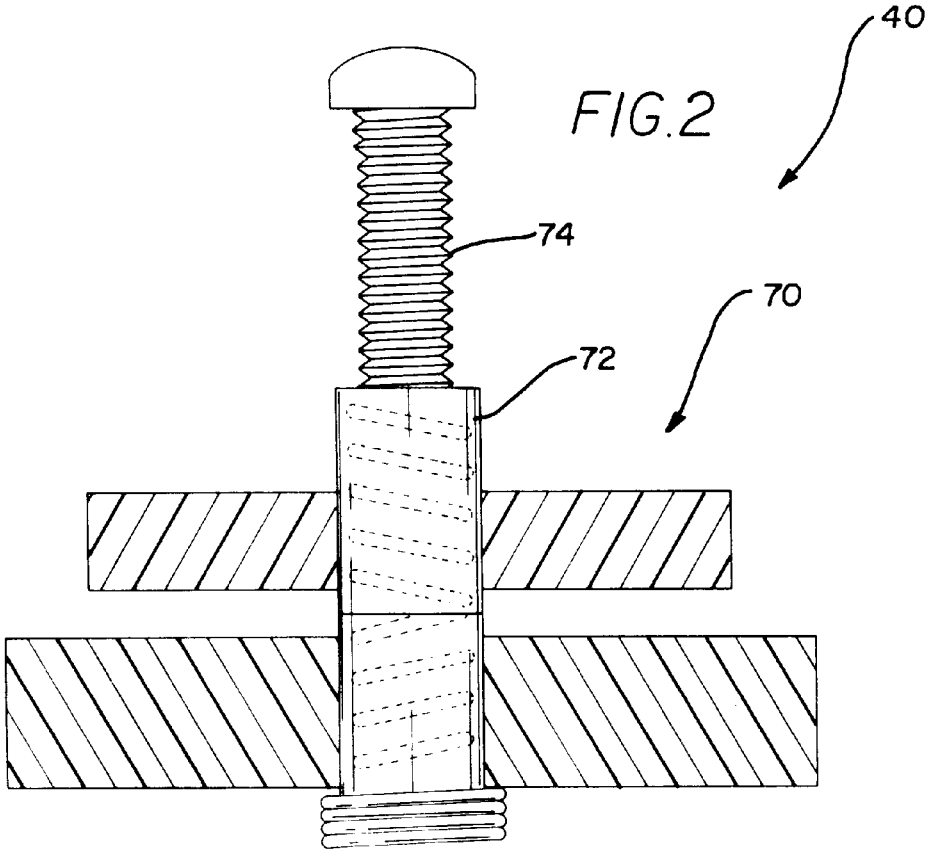
FIG. 2 is a side cross-sectional view of the second roulette assembly of the present invention.
Figure 3:
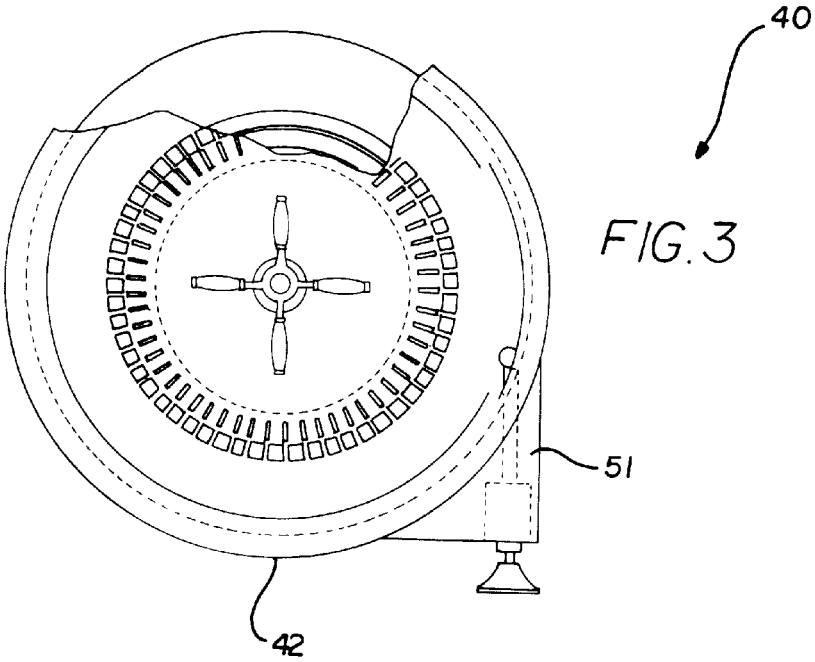
FIG. 3 is a top view of the second roulette assembly of the present invention.
Figure 4:
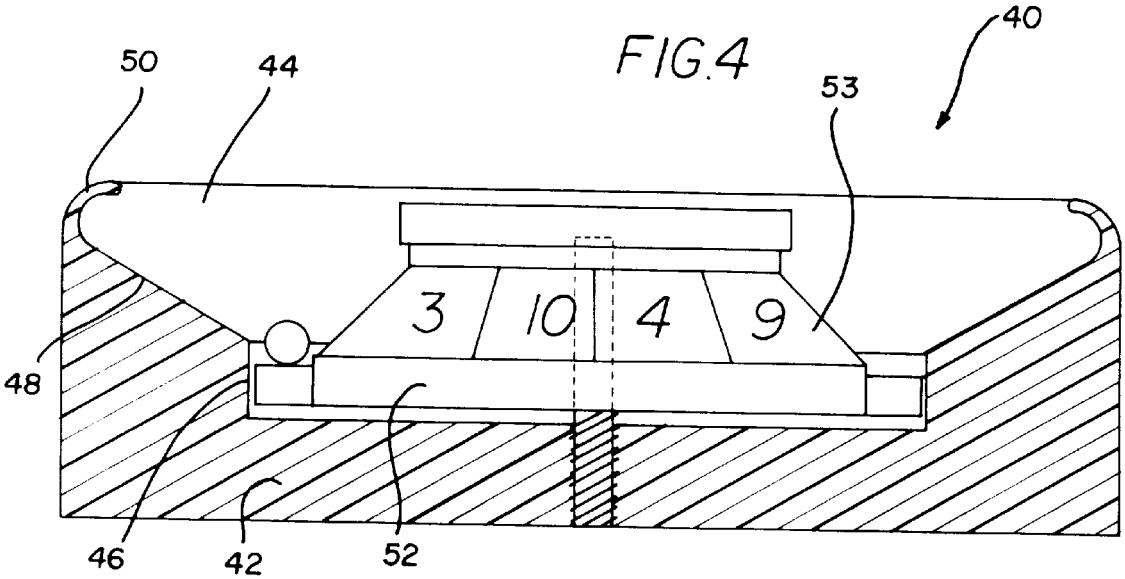
FIG. 4 is a side view of the second roulette assembly of the present invention.

It should be noted that either of the various features of the foregoing roulette assemblies may be used exclusively or in combination as a system. When used on ships or other moving vehicles, the bases of the roulette assemblies may be mounted in any commonly known way to enhance stability. While either roulette assemblies may be manually, electrically or mechanically spun, it is preferred that the second roulette assembly have a drive mechanism 70, as shown in FIG. 2. As shown, each wheel of the second roulette assembly preferably includes a sleeve 72 with threads formed therein. Such threads are spiraled in opposite directions (the size of the spirals in FIG. 2 are augmented for clarity). As such upon the depression of a threaded plunger 74 therein, the wheels are spun in opposite directions. In other variations, the wheel is adapted to spin in the same direction but at different speeds.

Figure 7:
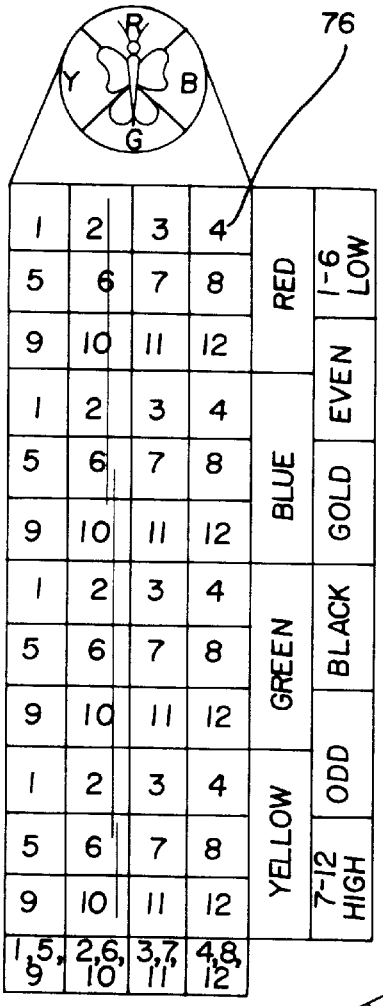
FIG. 7 is a top view of the betting mat of the present invention.
Figure 8:
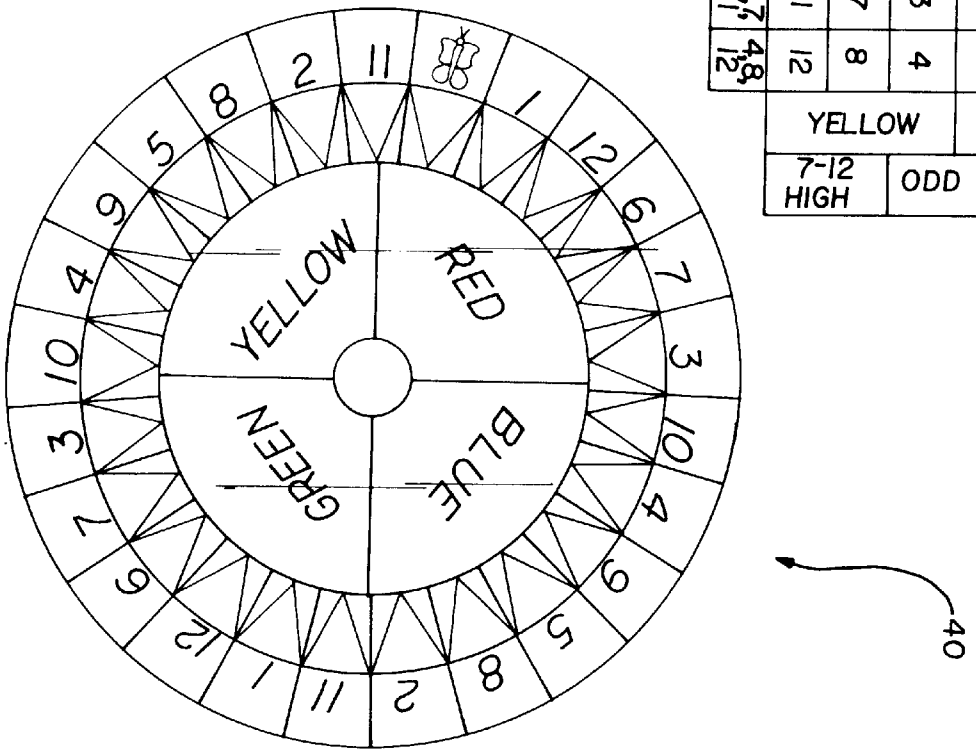
FIG. 8 is a top view of the second roulette assembly of the present invention with a first configuration.
Figure 9:
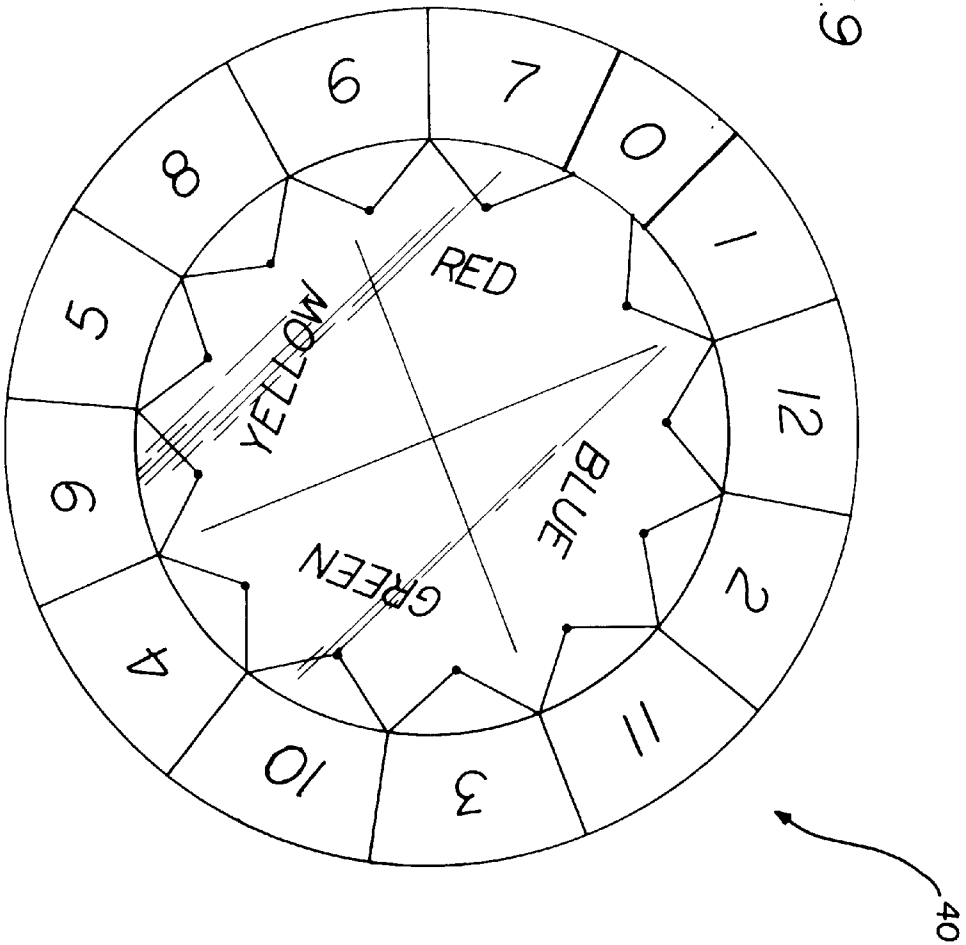
FIG. 9 is a top view of the second roulette assembly of the present invention with a second configuration.
Figure 10:
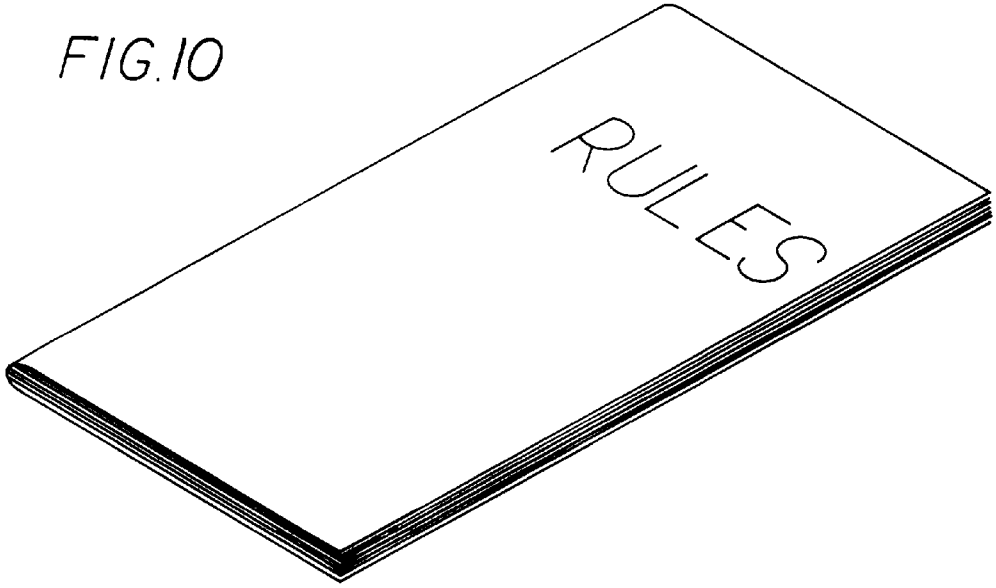
FIG. 10 is an illustration of the rule book associated with the present invention.

Finally, a betting mat 76 is provided for betting on various combinations of numbers and colors which are indicated by the roulette assembly. As shown in FIG. 7, the betting mat includes a central matrix of rectangles each having a unique number situated therein. Associated therewith is a first peripheral matrix of rectangles each having a unique color situated therein and a second peripheral matrix of rectangles each having a unique set of numbers situated therein. It should be noted that other various configurations of betting sections may be added per the desires of the user. Further, additional alternate uses of the present invention include, but are not limited to educational toy game versions in order to learn about numbers, alphabets and colors; theme board game versions; hand-held electronic game versions; slot machine game versions, compact disc game versions; gaming versions of use for Internet casinos; and lottery game versions.

In its essence, the present invention includes a method of play comprising the steps of randomly selecting one of a plurality of numbers; randomly selecting one of a plurality of colors; and generating a unique combination of a number and a color using the randomly selected number and the randomly selected color.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A roulette wheel system comprising:

a first roulette assembly including:

a base fixedly mounted on a recipient surface and including a circular bottom with a peripheral lip integrally coupled to a periphery of the circular bottom and extending upwardly therefrom, a lower wheel rotatably mounted on the base in concentric relationship therewith, the lower wheel including a circular bottom, an inner annular lip integrally coupled to the circular bottom at a location spaced from a periphery of the circular bottom and extending upwardly therefrom, an outer annular lip integrally coupled to the periphery of the circular bottom extending upwardly therefrom, a plurality of radially extending dividers mounted on the circular bottom between the inner annular lip and the outer annular lip to define a plurality of equally sized compartments, and a plurality of apertures each formed in the inner annular lip at one of the compartments, wherein each compartment has a unique number and color combination associated therewith, and an upper wheel rotatably mounted with respect to the lower wheel in concentric relationship therewith, the upper wheel having a diameter less than that of the inner annular lip of the lower wheel and a height equal to a height of the annular lips thereof, the upper wheel including a plurality of solenoids mounted on the upper wheel for selectively stopping rotational motion of the upper wheel with respect to the lower wheel and indicating the unique number and color combination of one of the compartments of the lower wheel, each of the solenoids extending in a radially outward direction from a center of the upper wheel and being oriented with substantially uniform angles therebetween, each solenoid including a transducer structure for selectively being retracted in and extended from the solenoid for randomly and removably inserting an outer end of the transducer structure into one of the apertures of the compartments of the lower wheel for precluding the rotation of the upper wheel with respect to the lower wheel and indicating one of the number and color combinations as a winner, wherein the outer end of the transducer structure has a substantially spherical portion for sliding along an inner surface of the inner annular lip until one of the apertures of the compartments is encountered by the outer end of the transducer structure, wherein each of the solenoids has a different color; and means for randomly actuating one of the solenoids of the upper wheel to extend the transducer structure of the solenoid; a second roulette assembly including:

a base fixedly mounted on a recipient surface and including a circular bottom, a recess formed in the bottom with a disk-shaped lower portion and an inverted frusto-conical upper portion, and a peripheral lip integrally coupled to a periphery of the circular bottom and extending upwardly therefrom, wherein the peripheral lip has a C-shaped cross-sectional along a length thereof, a lower wheel rotatably mounted within the disk-shaped lower portion of the recess of the base with a planar top face, a side wall with an upright frusto-conical configuration and a plurality of vertically oriented lines positioned thereon for defining equally space sections each with a unique number associated therewith, a horizontally oriented lower peripheral lip mounted on a bottom edge of the side wall and extending radially therefrom with a plurality of upwardly extending tabs in alignment with the lines of the sections, a plurality of vertically oriented posts each mounted to a periphery of the top face of the lower wheel at a central extent of one of the sections of the side wall thereof, and an upper wheel having a disk-shaped configuration rotatably mounted on the top face of the lower wheel, the upper wheel having a top face including a pair of intersecting lines positioned thereon for dividing the same into a plurality of equally sized sections each of which has a unique color associated therewith, the upper wheel further including a plurality of flexible resilient flaps coupled to a periphery of the upper wheel and extending radially therefrom in alignment with the lines of the upper wheel, wherein the flaps are adapted to be biased between each of the posts of the lower wheel; and a betting mat including a central matrix of rectangles each having a unique number situated therein, a first peripheral matrix of rectangles each having a unique color situated therein, and a second peripheral matrix of rectangles each having a unique set of numbers situated therein.

2. A roulette assembly comprising:

a base;

a lower wheel rotatably mounted on the base, the lower wheel including a bottom, an inner annular lip coupled to the bottom at a location spaced from a periphery of the bottom and extending upwardly therefrom, an outer annular lip coupled to the periphery of the circular bottom extending upwardly therefrom, a plurality of radially extending dividers mounted on the bottom between the inner annular lip and the outer annular lip to define a plurality of equally sized compartments between the inner and outer annular lips, and a plurality of apertures, each aperture being formed in the inner annular lip for communication with one of the compartments, wherein each compartment has a unique combination of a number marked thereon and a color marked thereon; and an upper wheel rotatably mounted with respect to the lower wheel, the upper wheel being mounted inside of the inner annular lip of the lower wheel, the upper wheel including a plurality of indicator assemblies mounted on the upper wheel for selectively stopping rotational motion of the upper wheel with respect to the lower wheel and indicating the unique number and color combination of one of the compartments of the lower wheel, each of the indicator assemblies extending in a radially outward direction from a center of the upper wheel and being oriented with substantially uniform angles therebetween, each of the indicator assemblies including an indicator for selectively being retracted inwardly from and extended outwardly of a periphery of the upper wheel for randomly and removably inserting an outer end of the indicator into one of the apertures of the compartments of the lower wheel for to preclude rotation of the upper wheel with respect to the lower wheel and indicating one of the number and color combinations as a winner.

3. A roulette assembly comprising:

a lower wheel divided into a plurality of sections each representative of at least one of a unique number and a unique color, a plurality of vertically oriented posts each mounted to a periphery of a top face of the lower wheel; and an upper wheel rotatably mounted on the lower wheel and divided into a plurality of sections each representative of at least one of a unique number and a unique color, the upper wheel including a plurality of flexible resilient flaps each coupled to a periphery of the upper wheel and extending radially from the upper wheel in alignment with lines between adjacent sections of the upper wheel, wherein the flaps are adapted to be biased between each of the posts of the lower wheel;

wherein upon the upper wheel and the lower wheel being spun and one wheel stopping relative to the other wheel such that the upper wheel and the lower wheel rotate at the same speed in the same direction, one of the sections of the lower wheel aligns with one of the sections of the upper wheel, thereby indicating a unique set of number and color combinations; and means defining a plurality of locations for receiving a ball wherein upon the ball being selectively released into the roulette assembly, the ball can randomly settle into one of said locations to identify the winning number and color combination from the unique set of number and color combinations.

4. A roulette assembly as set forth in claim 3 wherein the wheels rotate independently.

5. A roulette assembly as set forth in claim 3 and further including a drive mechanism for urging the wheels to rotate in opposite directions.

6. A roulette assembly as set forth in claim 3 and further including a base fixedly mounted on a recipient surface wherein the lower wheel is rotatably mounted on the base.

7. A roulette assembly as set forth in claim 3 and further including a drive mechanism for urging the wheels to rotate in a similar direction at different speeds.

8. A roulette assembly as set forth in claim 2 wherein the outer end of the indicator has a substantially spherical portion for sliding along an inner surface of the inner annular lip until one of the apertures of the compartments is encountered by the outer end of the indicator.

9. A roulette assembly as set forth in claim 2 wherein the indicator assemblies each comprise a solenoid.

10. A roulette assembly as set forth in claim 9 wherein the solenoids each have a different color.

* * * * *